US005458516A

United States Patent [19]

Uglene et al.

[11] Patent Number: 5,458,516

[45] Date of Patent: Oct. 17, 1995

[54] ATMOSPHERIC SELF INFLATABLE SUIT

[75] Inventors: Wendell V. Uglene, Burnaby; Brian Farnworth, Delta, both of Canada

[73] Assignee: M.E.T.A. Research Inc., Richmond, Canada

[21] Appl. No.: 257,253

[22] Filed: Jun. 8, 1994

[51] Int. Cl.[6] ..... B63C 9/093

[52] U.S. Cl. ..... 441/104; 2/2.16; 2/82; 2/DIG. 3; 441/90; 441/102

[58] Field of Search ..... 441/102–105, 441/90; 2/2.15, 2.16, 82, DIG. 3; 5/449; 137/223

[56] References Cited

U.S. PATENT DOCUMENTS

| | | | |
|---|---|---|---|
| 4,242,769 | 1/1981 | Rayfield et al. | 9/330 |
| 4,274,158 | 6/1981 | Pogorski et al. | 2/2.16 |
| 4,624,877 | 11/1986 | Lea et al. | 5/449 X |
| 5,067,921 | 11/1991 | Bramham | 441/102 |

FOREIGN PATENT DOCUMENTS

| | | | |
|---|---|---|---|
| 0212731 | 8/1921 | Canada . | |
| 1218801 | 3/1987 | Canada . | |
| 9116233 | 10/1991 | WIPO | 441/10 |

*Primary Examiner*—Sherman Basinger
*Attorney, Agent, or Firm*—C. A. Rowley

[57] ABSTRACT

An atmospheric air pressure inflatable garment has an inner layer and outer layer define a confined space with a compressible material therein. The compressible material has resiliency and strength characteristics so that it compresses under atmospheric conditions when the air pressure in the confined space is reduced to sub-atmospheric pressure and an air passage adapted to permit passage of air into and out of the confined space but not water when a seal for sealing the passage is released. The garment is stored with the air removed and permitting atmospheric air to fill the space when the seal is opened raise the pressure in the space to atmospheric and causes the compressible material to expand separating the inner and outer layers and forming an insulation therebetween.

20 Claims, 1 Drawing Sheet

ATMOSPHERIC SELF INFLATABLE SUIT

FIELD OF THE INVENTION

The present invention relates to a survival suit, more particularly, the present invention relates to a self inflating insulated suit that may be stored in a relatively small space.

BACKGROUND OF THE PRESENT INVENTION

Survival suits are used by the military and civilian agencies for protection of personnel in the case of accidents, for example, on or over cold water. These survival suits are intended to be quickly donned in an emergency and to provide thermal protection from relatively cold water. Generally, three types of survival suits are used.

The simpler suit consists of a waterproof fabric but does not prevent water from flowing into the suit through areas where appendages extend therefrom, i.e. around the neck, legs, arm, etc. This type of suit is low cost and is relatively light and may be packed in a volume to be carried at all times. However, it provides relatively short protection periods, less than half an hour within the cold water.

The second type of survival suit has better leg, wrist and neck seals and uses a waterproof zipper for donning and doffing. These suits are either worn constantly or donned on warning of eminent accident. They have the advantage of being wearable during normal duties and require only moderate volume of storage and provide longer protection generally about two hours.

A third type of suit is constructed of thick neoprene with good wrist seals or integrated mitts and zippers, but with relatively poor neck seals. These suits provide more protection, generally up to about six hours, even when not totally leak tight. However, they are extremely bulky when stored and impractical for performing any significant activity.

The concepts of double walled garments or suits appears in the patent literature, for example, in Canadian patent, 212731 issued Aug. 2, 1921 to Francis and 1,218,809 issued Mar. 10, 1987 to Forsberg.

The latter patent describes the use of Gore-tex membranes to permit ingress of air and water vapor from within the suit. Gore-tex is a vapor permeable, liquid (water) impermeable material, manufactured by W. L. Gore & Ass.

The concept of an inflatable suit is described in U.S. Pat. No. 4,242,769, issued Jan. 6, 1981 to Rayfield et al. This suits employs bladders that, under atmospheric conditions flatten or collapses to reduce wall thickness and which require the use of a positive air pressure, i.e. a pressure above atmospheric for inflation to expand the wall of the garment and provide space to improve the insulation value of the garment.

U.S. Pat. No. 5,067,921 issued Nov. 26, 1991 to Bramham discloses an inflatable garment wherein the inner wall of the garment is weaker than the outer wall so that on inflation of the bladder the inner wall is pressed toward the body thereby to improve the insulation value of the suit.

BRIEF DESCRIPTION OF THE PRESENT INVENTION

It is the main object of the present invention to provide a survival garment or suit having a thermal performance of the known relatively bulky survival suits but a packed volume and weight significantly smaller, yet one that permits easy donning and doffing.

Broadly, the present invention relates to an atmospheric pressure self inflating garment comprising an air impermeable inner layer and an air impermeable outer layer defining a confined space there between, means for permitting air flow through one of said layers while preventing the passage of water there through, compressible means within said space, said compressible means having sufficient resilience and strength to hold said inner and outer layers in space apart relationship when said space is at atmospheric pressure, yet not sufficiently strong to prevent being compressed by atmospheric pressure when a significant amount of air has been removed from said space and selectively openable means for sealing said means for permitting egress and ingress of air into said space.

Preferably, said means for permitting and ingress and egress of air will comprise passages through said outer layer.

Preferably, said means permitting for the ingress and egress of air will comprise patches of air permeable substantially liquid water impermeable material protected by a hydrophobic air and water vapor permeable layer on the side of said material remote from said space.

Preferably, said compressible means will comprise a low density open-celled foam, preferably, of polyurethane foam material.

Preferably, said compressible means will substantially fill said space.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
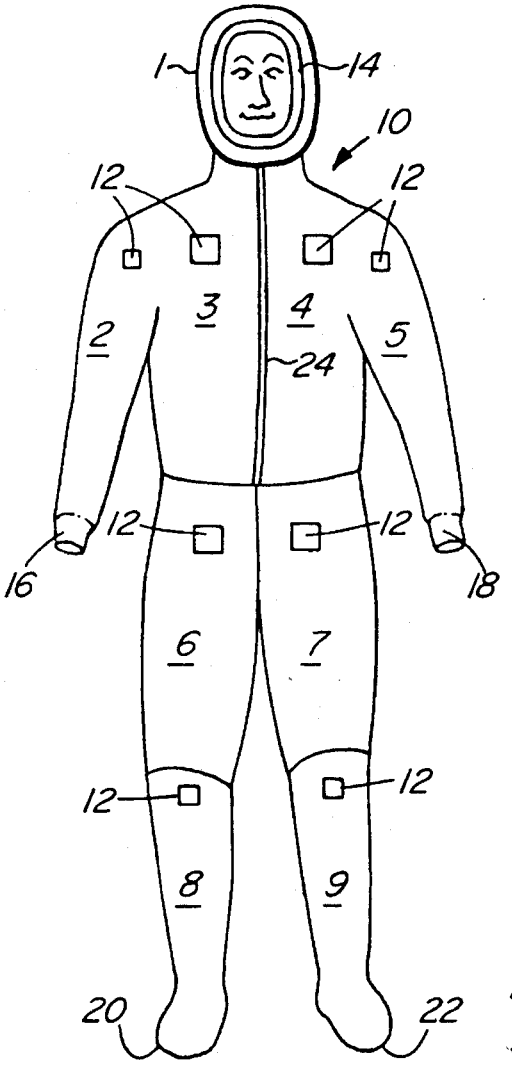
FIG. 1 is a schematic illustration of a suit constructed in accordance with the present invention.

As shown in FIG. 1, the suit 10 of the present invention is composed of a plurality of separate garment parts that may be welded together or otherwise secured together by a suitable seam structure to form the desired garment. The illustrated arrangement, suit 10 includes a head or hood portion 1, a right arm 2, right front 3, left front 4, left arm 5, right thigh 6, left thigh 7, right calf/foot 8 and left calf/foot 9, plus a back (not shown). Each of these portions, 1, 2, 3, etc. will form a separate self contained bladder and will be provided with separate air ingress and egress areas as depicted by the patches 12 and as will be described in more detail herein below.

The illustrated suit 10 has a face seal 14 preferably formed of neoprene and wrist seals 16 and 18 preferably of latex.

Preferably, each of the foot portions 8 and 9 will be provided by nonslip soles as indicated at 20 and 22.

The body portion of the suit 10 is preferably closable via a waterproof zipper or the like 24.

Figure 3:
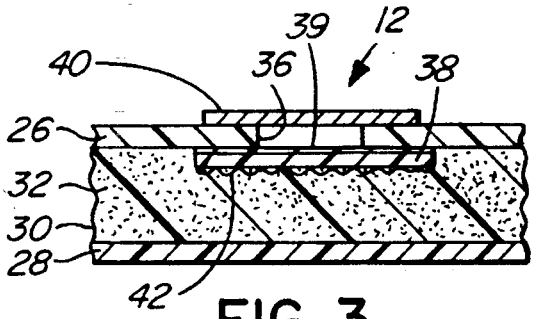
FIG. 3 is a schematic illustration through the wall of the suit illustrating an air permeable or "breathing" patch used in the present invention.

Referring to FIG. 3, each of the garment portions will be constructed in a similar way and will be composed of an outer layer 26 and an inner layer 28, both of which are preferably substantially air and water impermeable and will normally be made from a polyurethane coated nylon fabric, preferably of at least 70 denier and less than 200 denier.

The inner layer 28 and outer layer 26 are welded or otherwise seamed together around their peripheries to define a garment portion and to form each such garment portion as an air and water tight bladder (with the exception of the patch areas 12) and define the confined space 30 between the inner 28 and outer 26 walls. These garment sections 1, 2, 3, etc. as above indicated are welded or otherwise secured together to form the suit 10.

The confined space 30 contains a suitable compressible material 32 that will compress if the bladder or space 30 is vacated i.e. air sucked out and atmospheric pressure is applied to the outside of the garment. The compressible material 32 preferably will be a low density open-celled polyurethane foam (preferably about 25 to 35 kg/m$^3$) such as that sold under the trademark Airtex 4100 sold by Federal Foam Technologies or a similar open-celled foam sold under the trademark CONAFLEX F-25 sold by H. L. Blachford. Preferably the compressible material 32 will substantially fill the space 30.

The open-celled foam 32 preferably will extend over substantially the full area of the garment, i.e. substantially fill the space 30 between the inner and outer layers 26 and 28. There must at least be sufficient volume (area) of compressible material (foam) 32 to ensure the expansion of the foam expands the space 30 so that the required spacing of the inner and outer layers 26 and 28 is attained when air at atmospheric pressure is admitted into the space 30. The expandable foam or the like 32 must also occupy enough of the space 30 to ensure thermal movement of air in the space 30 does not significantly impair the insulating properties of the suit.

Open-celled foam 32 such as polyurethane foams referred to above are preferred, but it is also possible to use suitable open-cell polyvinyl chloride foam, thermoplastic honeycombs and battings such as glass and polyester nylon provided the pads or foam have the required resilience to compressibility to be compressed to the required degree when the air is withdrawn from between the layers 28 and 26 and to expand to the required size when air is admitted into the bladder space 30.

Closed-cell resilient material 32 preferably will not be used as it presents problems in that air passages must be provided for movement of air into and out of the space 30 to uniformly expand or collapse the walls of the garment portions, without permitting thermal movement of air in the space 30 that would reduce the insulation value of the suit. If closed-cell material is used the arrangement and amount of such material within the bladder space 30 must limit thermal movement of air to ensure the insulation value of the suit is not significantly impaired and must permit withdrawal of sufficient air from the bladder 30 to substantially uniformly collapse the compressible material 32 to significantly reduce the wall thickness of the suit 10 so that, when evacuated, it may be stored in a space significantly smaller than that used with conventional insulated suits offering the same protection.

Each of the patches 12 for ingress and egress of air are preferably constructed as illustrated in FIG. 3. A hole 36 is formed in the outer fabric 26 (placing the patch 12 on the inner wall 28 has not been found to be as effective) and covering the hole 36 with an air permeable, liquid impermeable microporous layer 38 of material which will generally be formed of a polytetrafluoroethylene (PTFE) film which functions as a "selective" valve by allowing air flow while preventing the ingress of liquid water into the space 30 which allows self-inflation even on intermittent immersion and requires no moving parts or activation by the user.

The layer 38 preferably has a hydrophobic coating on its face 39 exposed to the atmosphere which helps to prevent water penetration while not significantly impairing air transmission. If the coating is placed on the opposite side of the layer 38 it tends to cause the supporting fabric layer to fill with water and thereby limit or impair air transmission.

It is also important that an outside patch cover 40 protect the layer 38. This cover 40 is made of suitable material that does not trap water and significantly increase the resistance to air flow so that self-inflation is significantly hindered after immersion. It has found that with the use of a suitable polyvinyl coated scrim such as that sold under the trademark Scootgard by Vantage Industries performs satisfactorily.

When nylon or Nomex® (trademark of Dupont) fiber meshes were used as the protective cover 40, it was found that in some cases, the mesh retained water within the interfiber and interyarn region which significantly increased the resistance to air flow.

The layer 38 of liquid impermeable gas permeable microporous PTFE is preferably a Gore-tex® product sold by W. L. Gore & Assoc. under the trademark Gore-tex XCR41556.

A suitable reinforcing mesh 42, for example, made of nylon scrim, is applied on the inside of the PTFE gas permeable liquid impermeable film 38.

Figure 2:
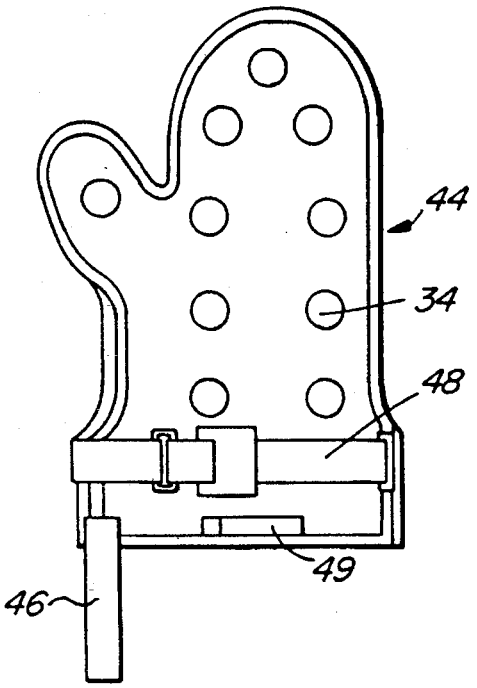
FIG. 2 shows a mitt construction that may be used with the present invention.

The mitt structure 44 as illustrated in FIG. 2 is constructed in a manner similar to the other garment parts i.e. with an inner and outer layer 28 and 26 forming a bladder 30 that is substantially filled with expandable material 32 (not indicated in FIG. 2). The inner and outer layers are welded together at spaced areas as indicated at 34 through holes diecut in the expandable material (foam) 32.

The particular form of mitt 44 shown in FIG. 2 is one form of mitt that may be used with the present invention. In this particular form, a strap such as the lanyard 46, is provided with for example Velcro® for cooperation with a suitable patch provided on the arm of the suit to hold the mitt 44 when not in place on the hand. A belt or the like 48 is used to tighten the mitt and prevent leakage and a suitable oral filler tube 49 is provided to permit oral inflation of the space 30 of the mitt 44 to above ambient pressure thereby expansion of the space 30 within the mitt 44.

Figure 4:
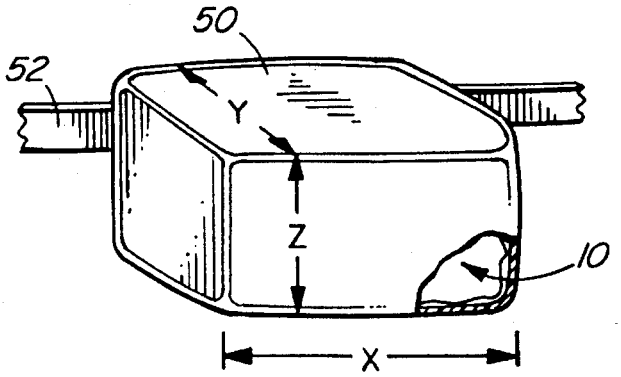
FIG. 4 shows a fanny pack arrangement for sealing and packaging of the suit of the present invention in deflated condition.

It is preferred to seal the patches 12 by placing of the whole garment within a bag such as the bag 50 shown in FIG. 4. This bag 50 is air and water proofed and the suit 10 is subjected to vacuum packaging when it is within the bag 50 and sealed therein to prevent the ingress of air into the suit 10. By packaging the whole suit within a sealed bag 50 breaking of the seal of the bag 50 to take the suit out, the patches 12 are subjected to air pressure which causes air to pass there through into the space 30 and inflate the space 30 permitting the foam 32 to expand and provide a insulated walls of the garment or suit 10. It will be apparent that once the suit is collapsed as long as it is suitably restrained from expansion air will not fill the bladders 30 in the garment portions and the suit will remain collapsed even if the seal on the bag 50 or other restraining device is broken.

Preferably, the bag 50 will be a fanny pack that may be held to the body of the wearer by a belt 52.

Applicant has found that by employing the present invention using a foam 32, about one quarter inch thickness and using at least 70 denier (preferably 100 denier) polyurethane coated nylon, a satisfactory, long term, i.e. significant time of exposure, could be built (CLO of about 1.0) and a thermal resistance of about 0.155 $m^2K/W$ may be produced that is packagable within a fanny pack having a volume of about 5.5 liters (i.e. X×Y×Z produces an internal volume of about 5.5 liters) and that the suit so produced using a 70 denier nylon as the inner and outer layers (nylon coated with polyurethane) weigh approximately 2.4 kg. When heavier weights of nylon (100 denier) were used, the weight was slightly over 3 kg and when the weight of the nylon was increased to a 200 denier polyurethane coated nylon using a foam thickness of 1.3 cm (about ½ inch) weight increased to over 3.5 kg. However, with the heavier nylon and thicker foam, the activity of the wearer was considerably impaired.

Having described the invention, modifications will be evident to those skilled in the art without departing from the scope of the invention as defined in the appended claims.

We claim:

1. An atmospheric pressure self inflating garment comprising an air impermeable inner layer and an air impermeable outer layer defining a confined space there between, means for permitting ingress and egress of air at substantially atmospheric pressure to and from said space through one of said layers while preventing passage of water there through, compressible means within said space, said compressible means having sufficient resilience and strength to expand and hold said inner and outer layers in spaced apart relationship when air pressure in said space is changed from sub-atmospheric to atmospheric pressure, yet not sufficiently strong to prevent being compressed by atmospheric pressure when a significant amount of air has been removed from said space and said garment is held in a collapsed condition by external atmospheric air pressure and releasable means for substantially preventing flow of ambient atmospheric air through said means for permitting egress and ingress of air into said space substantially only when said garment is in said collapsed condition.

2. An atmospheric pressure self inflating garment as defined in claim 1 wherein said means for permitting ingress and egress of air comprises passages through said outer layer.

3. An atmospheric pressure self inflating garment as defined in claim 2 wherein said means for permitting the ingress and egress of air comprises at least one patch of air permeable substantially liquid water impermeable material protected by a hydrophobic air permeable layer on the side of said material remote from said space.

4. An atmospheric pressure self inflating garment as defined in claim 3 wherein said compressible means comprises a low density open-celled foam.

5. An atmospheric pressure self inflating garment as defined in claim 4 wherein said compressible means comprises a low density open-celled polyurethane foam material.

6. An atmospheric pressure self inflating garment as defined in claim 4 wherein said compressible means substantially fills said space.

7. An atmospheric pressure self inflating garment as defined in claim 3 wherein said compressible means substantially fills said space.

8. An atmospheric pressure self inflating garment as defined in claim 2 wherein said compressible means comprises a low density open-celled foam.

9. An atmospheric pressure self inflating garment as defined in claim 8 wherein said compressible means comprises a low density open-celled polyurethane foam material.

10. An atmospheric pressure self inflating garment as defined in claim 8 wherein said compressible means substantially fills said space.

11. An atmospheric pressure self inflating garment as defined in claim 1 wherein said means for permitting the ingress and egress of air comprises at least one patch of air permeable substantially liquid water impermeable material protected by a hydrophobic air permeable layer on the side of said material remote from said space.

12. An atmospheric pressure self inflating garment as defined in claim 11 wherein said compressible means comprises a low density open-celled foam.

13. An atmospheric pressure self inflating garment as defined in claim 12 wherein said compressible means comprises a low density open-celled polyurethane foam material.

14. An atmospheric pressure self inflating garment as defined in claim 12 wherein said compressible means substantially fills said space.

15. An atmospheric pressure self inflating garment as defined in claim 11 wherein said compressible means substantially fills said space.

16. An atmospheric pressure self inflating garment as defined in claim 1 wherein said compressible means comprises a low density open-celled foam.

17. An atmospheric pressure self inflating garment as defined in claim 16 wherein said compressible means comprises a low density open-celled polyurethane foam material.

18. An atmospheric pressure self inflating garment as defined in claim 17 wherein said compressible means substantially fills said space.

19. An atmospheric pressure self inflating garment as defined in claim 16 wherein said compressible means substantially fills said space.

20. An atmospheric pressure self inflating garment as defined in claim 1 wherein said compressible means substantially fills said space.

* * * * *